US007403107B2

(12) United States Patent
Ito et al.

(10) Patent No.: US 7,403,107 B2
(45) Date of Patent: Jul. 22, 2008

(54) LIGHTING CONTROL CIRCUIT FOR VEHICLE LIGHTING EQUIPMENT

(75) Inventors: Masayasu Ito, Shizuoka (JP); Hitoshi Takeda, Shizuoka (JP)

(73) Assignee: Koito Manufacturing Co., Ltd, Tokyo (JP)

( * ) Notice: Subject to any disclaimer, the term of this patent is extended or adjusted under 35 U.S.C. 154(b) by 197 days.

(21) Appl. No.: 11/217,519

(22) Filed: Sep. 1, 2005

(65) Prior Publication Data

US 2006/0055244 A1 Mar. 16, 2006

(30) Foreign Application Priority Data

Sep. 3, 2004 (JP) ..... 2004-256826

(51) Int. Cl.
*B60Q 11/00* (2006.01)

(52) U.S. Cl. ..... 340/458; 340/459; 340/815.45

(58) Field of Classification Search ..... 340/457.2, 340/457.3, 457.4, 458, 459, 463, 464, 468, 340/469, 475, 815.45; 315/76, 291; 307/10.4, 307/10.1

See application file for complete search history.

(56) References Cited

U.S. PATENT DOCUMENTS

| | | | | |
|---|---|---|---|---|
| 5,463,294 | A * | 10/1995 | Valdivia et al. | 318/432 |
| 6,469,404 | B1 * | 10/2002 | Pohjola | 307/10.1 |
| 6,490,512 | B1 * | 12/2002 | Niggemann | 701/29 |
| 6,714,128 | B2 * | 3/2004 | Abbe et al. | 340/468 |
| 6,858,986 | B2 * | 2/2005 | Monk | 315/76 |
| 6,909,944 | B2 * | 6/2005 | Pillar et al. | 701/1 |
| 7,135,664 | B2 * | 11/2006 | Vornsand et al. | 250/205 |
| 7,173,383 | B2 * | 2/2007 | Vornsand et al. | 315/291 |
| 2004/0036418 | A1 | 2/2004 | Rooke et al. | |

FOREIGN PATENT DOCUMENTS

| | | |
|---|---|---|
| DE | 197 32 828 | 1/2001 |
| EP | 1 006 506 | 6/2000 |
| EP | 1 113 708 | 7/2001 |
| GB | 2 369 730 | 6/2002 |
| JP | 2002-231013 | 8/2002 |

OTHER PUBLICATIONS

Patent Abstracts of Japan, Publication No. 2002-231013, Publication Date: Aug. 16, 2002, 2 pages.
German Office Action for German Patent Application No. 10 2005 041 792.2-31, dated Oct. 1, 2007, and English Translation thereof, 6 pages.

* cited by examiner

*Primary Examiner*—Van T. Trieu
(74) *Attorney, Agent, or Firm*—Osha Liang LLP

(57) ABSTRACT

A control unit for generating control signals in response to a communication signal fed from a vehicle, and a plurality of supply units for controlling a supply F of current to respective LEDs in compliance with the control signals generated by the control unit are provided. The control unit changes contents of the control signals in answer to the contents of the communication signal, i.e., to meet to changes of specifications when contents of the communication signal are different every type of a car or every vehicle, whereby standardization of circuit configurations can be achieved.

8 Claims, 6 Drawing Sheets

LIGHTING CONTROL CIRCUIT FOR VEHICLE LIGHTING EQUIPMENT

BACKGROUND OF THE INVENTION

1. Technical Field

The present invention relates to a lighting control circuit for vehicle lighting equipment and, more particularly, a lighting control circuit for vehicle lighting equipment constructed to control the lighting of a semiconductor light source that is composed of a semiconductor light emitting device.

2. Related Art

In the prior art, the vehicle lighting equipment using the semiconductor light emitting device such as LED (Light Emitting Diode), or the like as the light source is known (for example, JP-A-2002-231013 (page 2 to page B4, FIG. 1 to FIG. 5)). In case the vehicle lighting equipment is constructed by using the LED as the light source, a wide variety of specifications are provided for such lighting equipment because the lighting equipment acts the eye of the vehicle and also the design aspect is looked upon as important. For example, according to the vehicle (type of a car), the number of used LEDs is different, a shape and a size of the lighting equipment itself are different, a circuit configuration of the lighting control circuit for the vehicle lighting equipment used to control ON/OFF and the brightness of respective LEDs is different, and so on. Various variations can be made.

SUMMARY OF THE INVENTION

If individual circuit developments are carried out to get various variations, the manufacturer is forced to put a huge amount of development costs in such developments. For example, upon constructing the (one by one) system in which one circuit is correlated with one LED, the driving circuit must be composed according to the type of LED, or the driving circuit must be composed according to the type of the car. Consequently, an increase in cost of the product is caused with an increase in the circuit development costs.

One or more embodiments of the present invention standardize respective circuits that drive semiconductor light sources composed of semiconductor light emitting devices.

In accordance with one or more embodiments, a lighting control circuit for vehicle lighting equipment comprises control signal generating means for generating control signals in response to a communication signal fed from a vehicle; and plurality of current supplying means for controlling a supply of current to a plurality of semiconductor light sources in compliance with the control signals generated by the control signal generating means; wherein, when a change is made to contents of the communication signal from the vehicle, the control signal generating means changes contents of the control signals in answer to the contents of the communication signal.

(Effect) The lighting control circuit for the vehicle lighting equipment for driving a plurality of semiconductor light sources composed of the semiconductor light emitting devices is constructed separately as a plurality of current supplying means that supplies the current (power) to the semiconductor light sources respectively, and the control signal generating means that outputs the common control signal to respective current supplying means, and then contents of the control signal are changed to satisfy the changed specifications when contents of the communication signal fed from the vehicle are changed, e.g., when the specifications are changed every type of the car or every car. Therefore, this lighting control circuit for the vehicle lighting equipment can deal with even when the specifications are changed according to the type of the car or the car, and thus standardization of the circuit configuration can be achieved. As a result, this lighting control circuit for the vehicle lighting equipment can reduce development costs and in turn contribute to a cost reduction of the product.

In accordance with one or more embodiments, the plurality of current supplying means take a same action on a same control signal out of the control signals generated by the control signal generating means respectively.

(Effect) Since the current supplying means take the same action on the same control signal respectively, such current supplying means can cause respective semiconductor light sources to take the same action even when types of the semiconductor light sources connected to respective current supplying means are different. For example, assume that an analog signal is used as the control signals, ON/OFF and dimming of the semiconductor light source are controlled by the voltage of the analog signal, and the light source is lighted by 5 V, 0 V, and 2.5 V in a full lighting mode, a non-lighting mode, and a 50% dimmed lighting mode respectively. The semiconductor light sources connected to the current supplying means are turned on in a full lighting mode when 5 V is input into the current supplying means as the control signal, and the semiconductor light sources connected to the current supplying means are turned off when 0 V is input into the current supplying means as the control signal. Also, the semiconductor light sources connected to the current supplying means are turned on in a 50% dimmed lighting mode when 2.5 V is input into the current supplying means as the control signal. In this manner, since all the current supplying means take the same action against the control signal, there is no need to take the hardware treatment of every vehicle or every product, and in addition this lighting control circuit for the vehicle lighting equipment can be assembled not to correlate the control signal with each current supplying means on a one-to-one basis.

In accordance with one or more embodiments, the control signal generating means includes a pair of power supply input terminals connected to a DC power supply loaded on the vehicle, and a plurality of power supply output terminals for distributing a DC power supplied to the pair of power supply input terminals to the current supplying means, and also includes a reverse-connected protecting element connected to one power supply input terminal of the pair of power supply input terminals or a surge protecting element for absorbing a surge voltage applied between the pair of power supply input terminals, or a noise filter for eliminating a noise component superposed onto a DC signal being input via the reverse-connected protecting element and then outputting the DC signal, from which the noise component is eliminated, to the power supply output terminals;

(Effect) When the DC power that is input into a pair of power supply input terminals from the DC power supply loaded on the vehicle is supplied to a plurality of power supply output terminals via the reverse-connected protecting element or the surge protecting element or the noise filter, such DC power is distributed to respective supply units from the power supply output terminals. Therefore, the number of wirings can be reduced with respect to the case where the configuration for supplying the DC power to respective supply units from the DC power supply loaded on the vehicle is employed, and also a reduction in costs required for the wirings can be achieved. Also, in a case of a DC voltage with different polarities applied to a pair of power supply input terminals, applying the reverse voltage to the current supplying means can be prevented by the reverse-connected protecting element. In addition, in case the surge voltage is applied between a pair of power supply input terminals, such surge voltage can be absorbed by the surge protecting element. Further, in case the signal containing the noise is input from a pair of power supply input terminals, this noise component can be eliminated by the noise filter.

In accordance with one or more embodiments, the plurality of current supplying means includes abnormality sensing means for outputting an abnormal signal on control signal lines, which connect the control signal generating means and the plurality of current supplying means respectively, when the abnormality sensing means senses an abnormality caused due to a supply of power to the semiconductor light sources, and the control signal generating means includes abnormal information outputting means for outputting the control signals on the control signal lines, and also monitoring respective states of the control signal lines to output an abnormal information when the abnormal signal is input from any of the plurality of current supplying means.

(Effect) When the abnormality is caused due to a supply of the power to the semiconductor light sources, for example, when the current supplied to the semiconductor light sources is decreased lower than a set value or when the voltage applied to the semiconductor light sources is decreased lower than a set voltage, an abnormal signal is output on the control signal line and also abnormal information is output based on the abnormal signal. Therefore, if this abnormal information is sent to the driver, the driver can be informed of the fact that the abnormality occurs in any semiconductor light source.

As apparent from the above explanation, according to one or more embodiments, a lighting control circuit for the vehicle lighting equipment can achieve the standardization of the circuit configuration, and can reduce the development costs, and in turn can contribute a cost reduction of the product.

According toone or more embodiments, a lighting control circuit for the vehicle lighting equipment can be assembled not to correlate the control signal with each current supplying means on a one-to-one basis.

According to one or more embodiments, a reduction in costs required for the wirings can be achieved. Also, because the reverse-connected protecting element is provided, it can be prevented that, when the DC power supply is connected reversely to the power supply input terminals, the reverse voltage is applied to the current supplying means. In addition, because the surge protecting element is provided, the surge voltage can be absorbed by the surge protecting element when such surge voltage is applied between a pair of power supply input terminals. Further, because the noise filter is provided, the noise component can be eliminated by the noise filter when the signal containing the noise is input from a pair of power supply input terminals.

According to one or more embodiments, if the abnormal information is supplied to the driver, the driver can be informed of the fact that the abnormality occurs in any semiconductor light source.

DETAILED DESCRIPTION OF THE INVENTION

Figure 1:
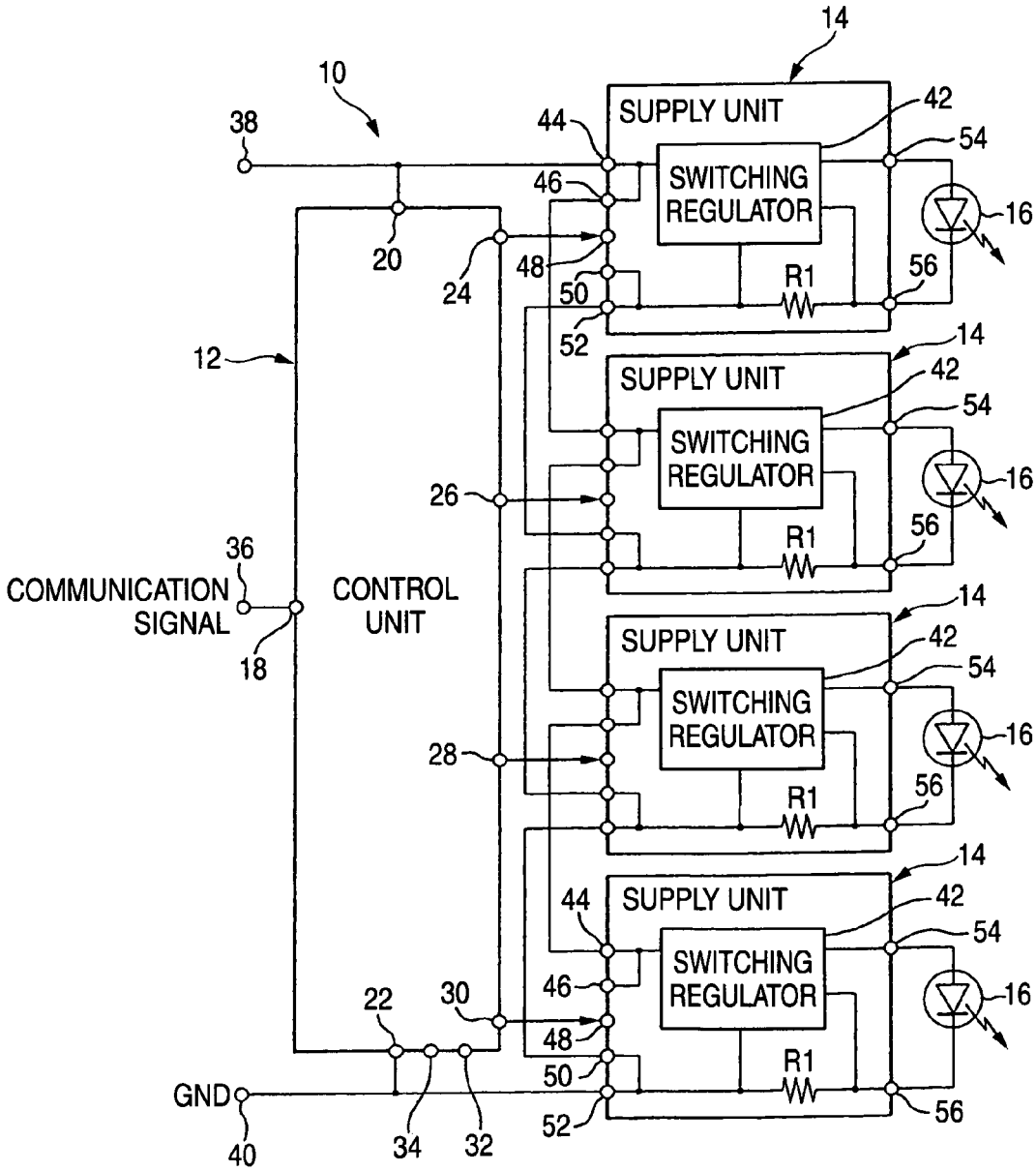
[FIG. 1] A block circuit diagram of a lighting control circuit for vehicle lighting equipment showing a first embodiment of the present invention.
Figure 2:
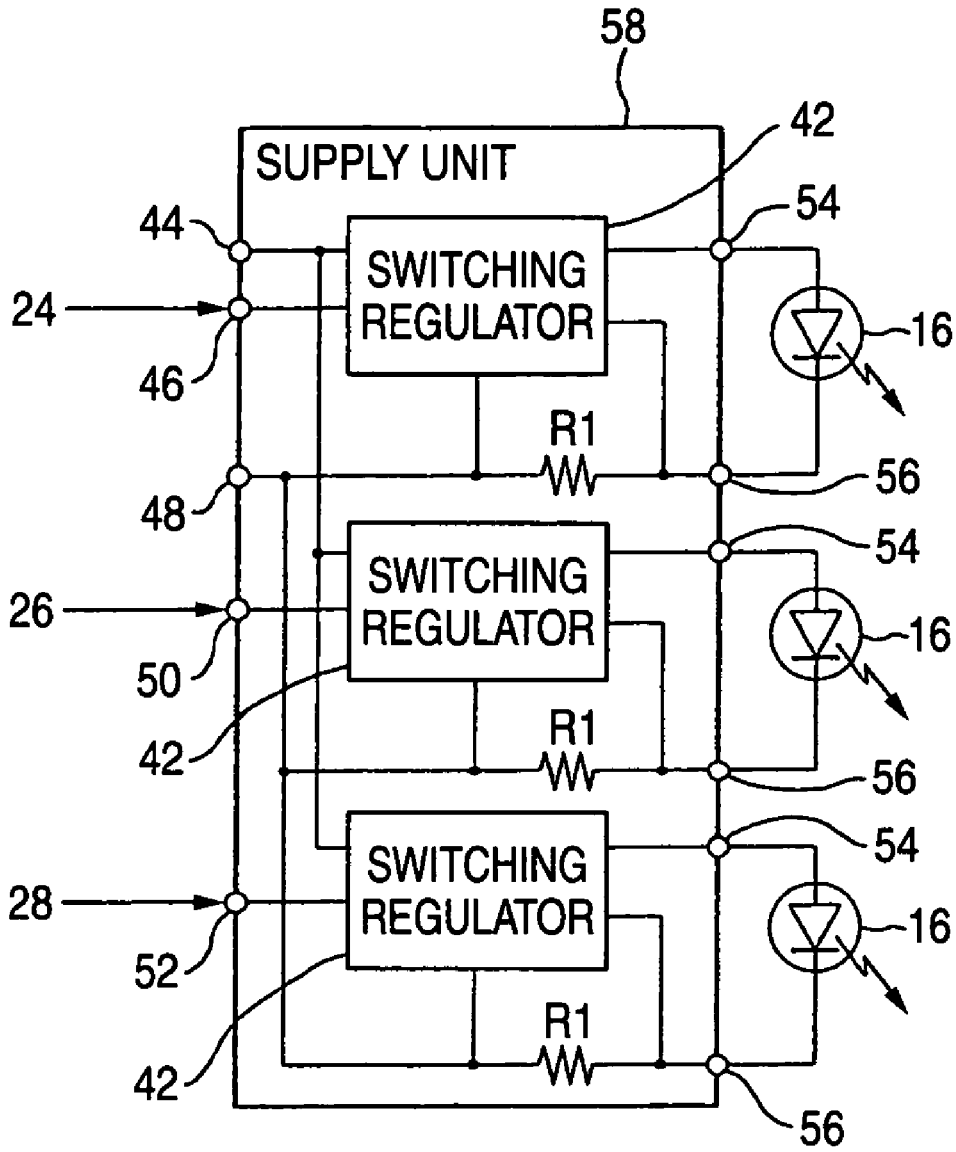
[FIG. 2] A block circuit diagram of a single supply unit to which three switching regulators.
Figure 3:
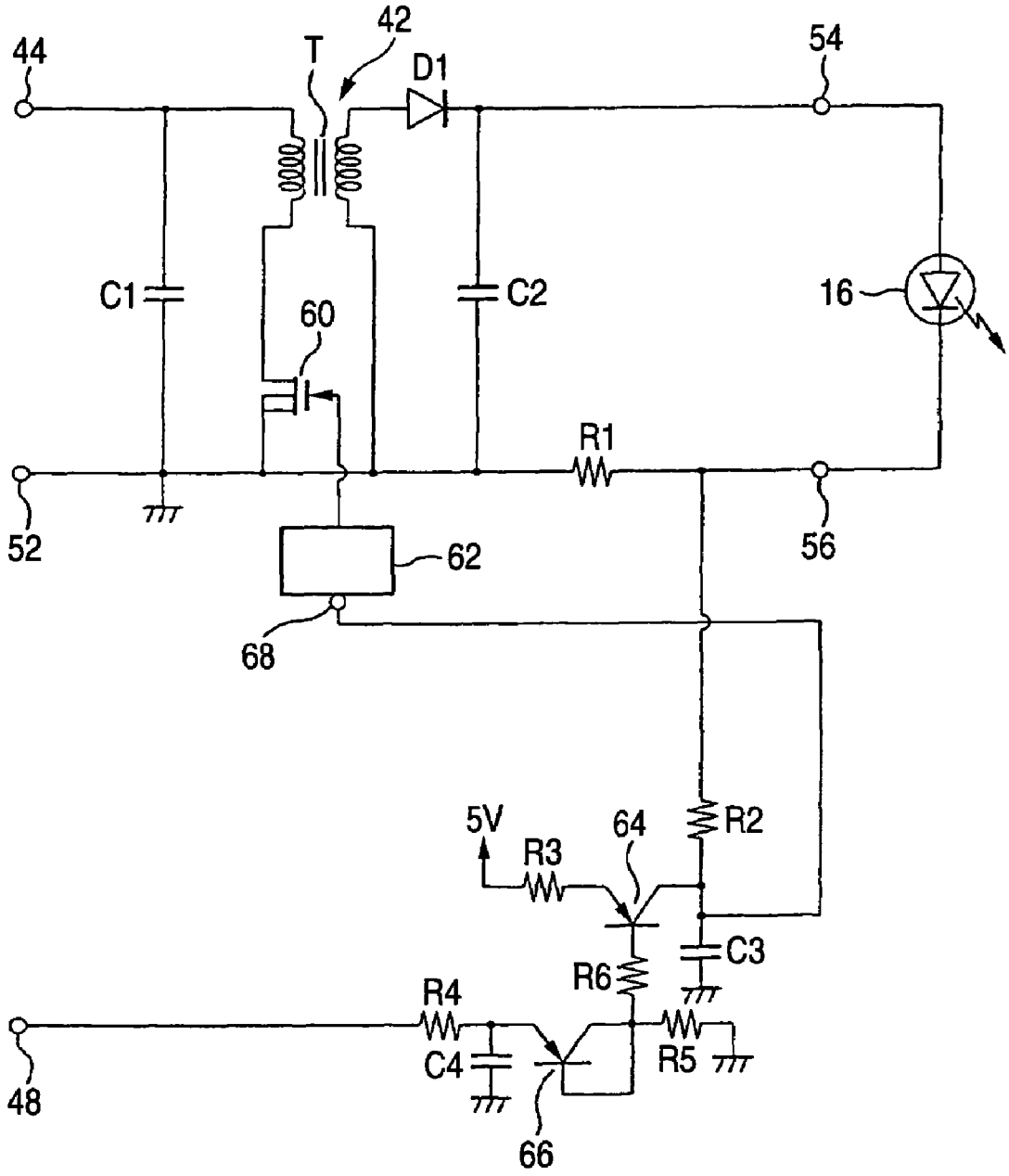
[FIG. 3] A circuit diagram of the supply unit.
Figure 4:
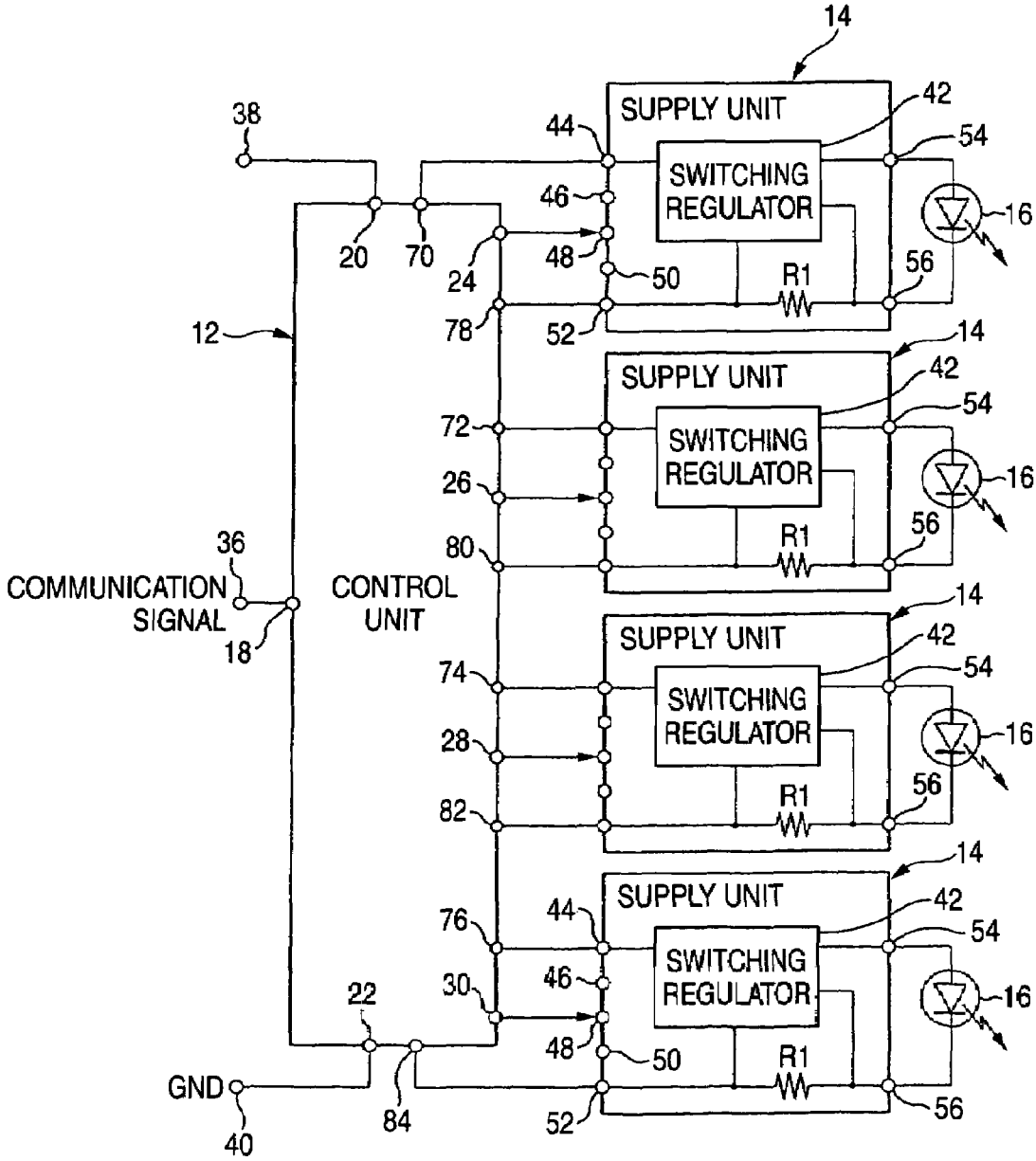
[FIG. 4] A block circuit diagram of a lighting control circuit for vehicle lighting equipment showing a second embodiment of the present invention.
Figure 5:
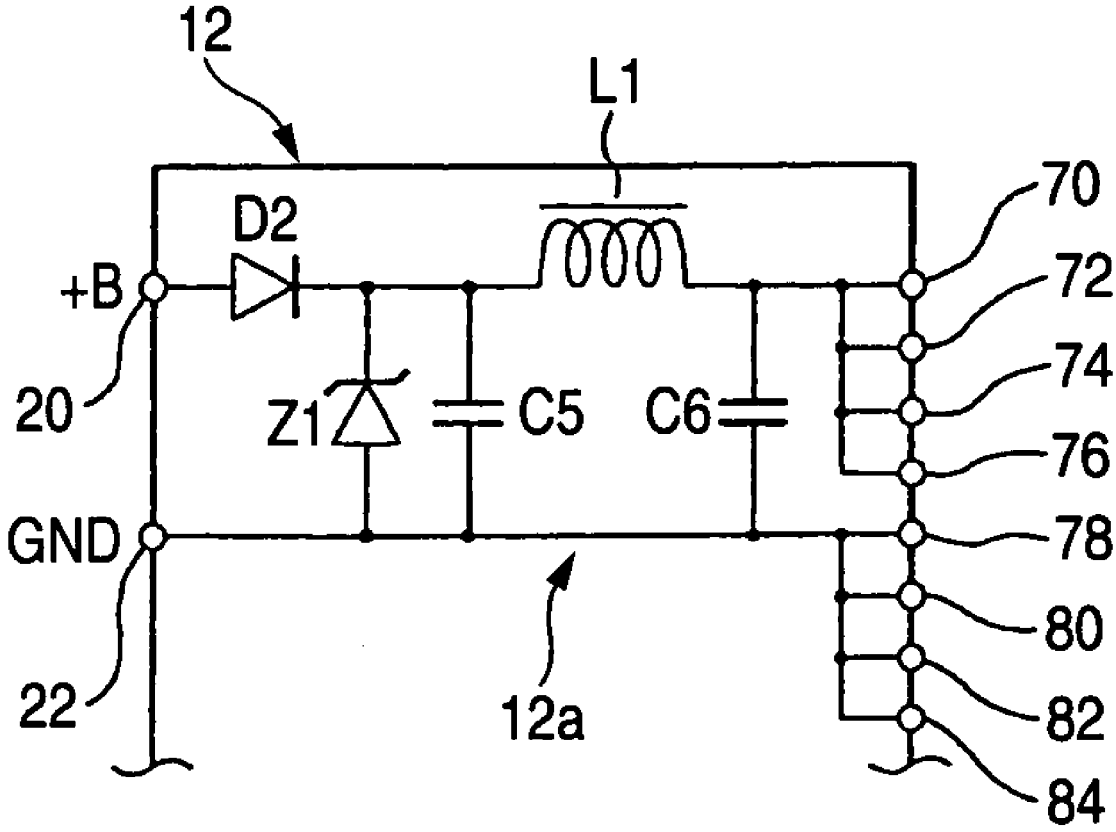
[FIG. 5] A circuit diagram of a control unit to which a noise filter, and the like are provided.
Figure 6:
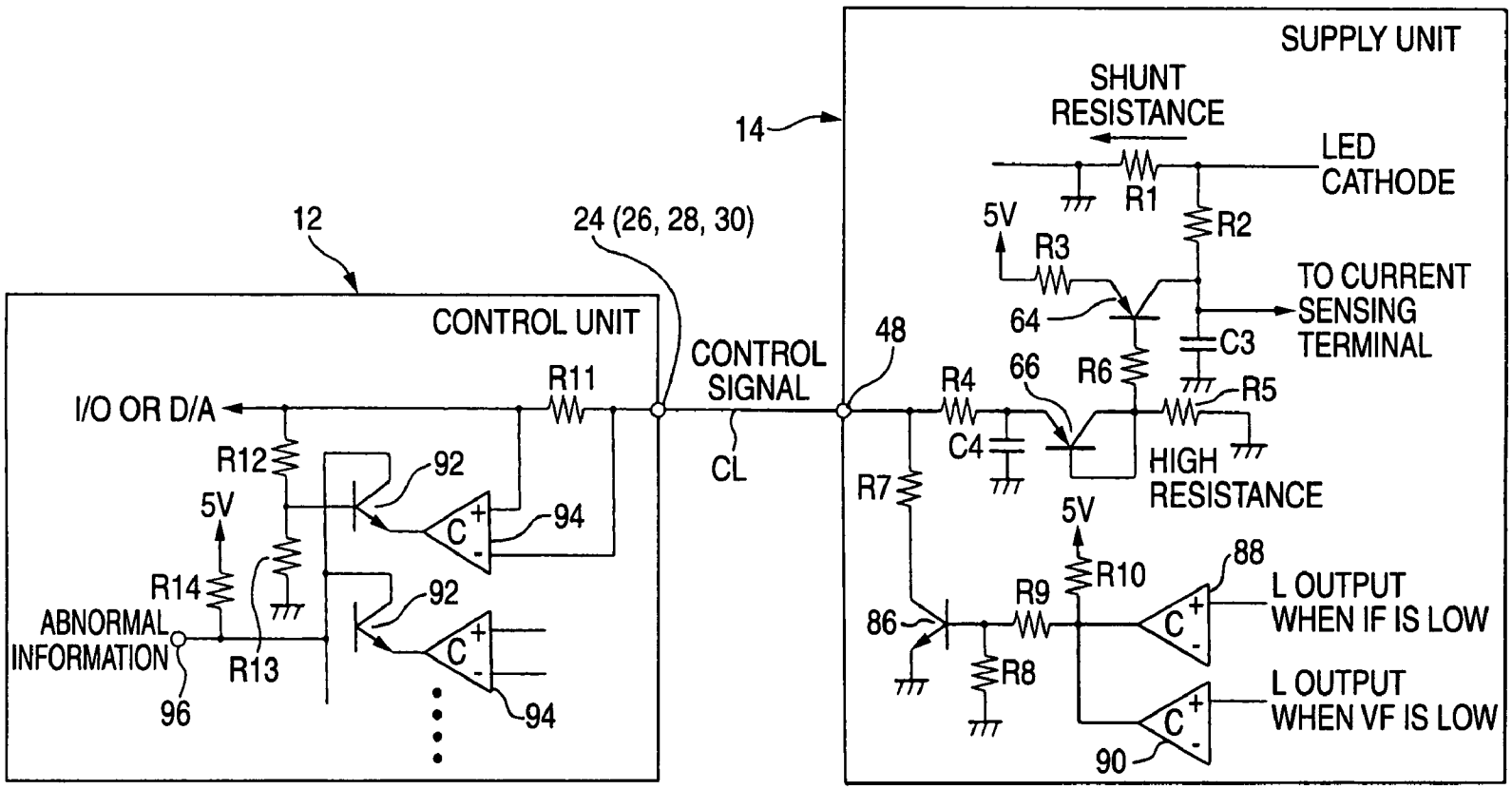
[FIG. 6] A block circuit diagram of a lighting control circuit for vehicle lighting equipment showing a third embodiment of the present invention.

Next, embodiments of the present invention will be explained with reference to examples. FIG. 1 is a block circuit diagram of a lighting control circuit for vehicle lighting equipment showing a first embodiment of the present invention. FIG. 2 is a block circuit diagram of a single supply unit to which three switching regulators. FIG. 3 is a circuit diagram of the supply unit. FIG. 4 is a block circuit diagram of a lighting control circuit for vehicle lighting equipment showing a second embodiment of the present invention. FIG. 5 is a circuit diagram of a control unit to which a noise filter, and the like are provided. FIG. 6 is a block circuit diagram of a lighting -control circuit for vehicle lighting equipment showing a third embodiment of the present invention.

In these Figures, a lighting control circuit 10 for vehicle lighting equipment includes a single control unit 12 and a plurality of supply units 14, as an element of the vehicle lighting equipment. The control unit 12 and respective supply units 14 are packaged onto a substrate (not shown). Each supply unit 14 is connected to an LED 16 serving as a semiconductor light source that is composed of a semiconductor light emitting device. The LEDs 16 can be used as the light source for various vehicle lighting equipments such as the headlamp, the stop and tail lamp, the fog lamp, the turn signal lamp, and the like.

The control unit 12 is constructed by a microcomputer having CPU, RAM, and ROM, for example. A signal input terminal 18, power supply terminals 20, 22, and distribution terminals 24, 26, 28, 30, 32, 34 are provided to the control unit 12. The signal input terminal 18 is connected to a communication signal input terminal 36. A communication signal is input into the communication signal input terminal 36 from a control device that controls the engine, etc. of the vehicle. The power supply terminal 20 is connected to a positive terminal (+B) of a battery (DC power supply) loaded onto the vehicle via a power supply input terminal 38 whereas the power supply terminal 22 is connected to a negative terminal (GND) of the battery via a power supply input terminal 40. The distribution terminals 24, 26, 28, 30 out of the distribution terminals 24 to 34 are connected to the supply unit 14 respectively, but the distribution terminals 32, 34 are not connected to the supply unit 14 to act as a connectionless terminal. Poles (contacts) of a socket connected to the distribution terminals 32, 34 are maintained at a Low potential or a high impedance (HZ) and thus are not affected, no matter how the poles of the socket and a car body (GND) are short-circuited.

The control unit 12 is constructed as a control signal generating means that generates control signals in response to the communication signal when the communication signal is input into the signal input terminal 18, and then distributes the generated control signals to respective supply units 14 from the distribution terminals 24, 26, 28, 30. The control signals are generated based on the communication signal as signals that are used to control ON/OFF or the brightness of respective LEDs 16. Sometimes contents of the communication signal are different according to the type of the car or the vehicle. Therefore, in the present embodiment, it should be supposed that, when the contents of the communication signal are different according to the vehicle or the type of the car, it is interpreted that such contents of the input communication signal were changed and then the contents of the control signals are changed or rewritten to meet the change of the communication signal, i.e., the change of the specifications.

For example, assume that an analog signal is used as the control signals, ON/OFF and dimming of the LED are controlled by a voltage of the signal, and the LED is lighted by 5 V, 0 V, and 2.5 V in a full lighting mode, a non lighting mode, and a 50% dimmed lighting mode respectively. In some types of cars, when all the LEDs 16 are to be lighted in a full lighting mode, the 5 V control signals are generated. In contrast, in the other types of cars, when only a single LED 16 is to be lighted in a full lighting mode and the remaining LEDs 16 are to be turned off, one 5 V control signal is generated as the control signal applied to a single supply unit 14 and 0 V control signals are generated as the control signals applied to remaining supply units 14.

Also, assume that a pulse signal is used as the control signals and the LED is lighted by 5 VDC, 0 VDC, and a 50% duty voltage in a full lighting mode, a non-lighting mode, and a 50% dimmed lighting mode respectively. For example, when the contents of the communication signal were changed according to the type of the car, the specifications of the pulse signal are changed to meet the change of the communication signal. Also, when the contents of the communication signal were changed according to a speed or a steering angle, the change of the communication signal are changed to meet the change of the speed or the steering angle.

Meanwhile, each supply unit 14 is constructed to have a switching regulator 42 and a shunt resistor R1, as a current supplying means. Terminals 44, 46, 48, 50, 52, 54, 56 are provided. The terminals 44, 46 are connected to the power supply input terminal (+B) 38, the terminals 48 are connected to the distribution terminals 24, 26, 28, 30, the terminals 50, 52 are connected to the power supply input terminal (GND) 40, and the LED 16 is connected in series with the terminals 54, 56. The switching regulator 42 controls the current supplied to each LED 16 as the feedback switching regulator such that a voltage developed across the shunt resistor R1 can be kept constant, i.e., the current flowing through the LED 16 can be kept constant. Each supply unit 14 controls the current flowing through the LED 16 to conform to the characteristics or specifications of the LED 16. An output current of the switching regulator 42 is differentiated according to the characteristics of the LED 16.

In this case, the supply units 14 are constructed to take the same action in response to the same control signal respectively. More particularly, under the assumption that the analog signal is used as the control signals and the LED is fully lighted by 5 V, the LED is turned off by 0 V, and the LED is 50% dimmed by 2.5 V, each supply unit 14 fully turns on the LED 16 when the 5 V control signal is input into each supply unit 14, each supply unit 14 turns off the LED 16 when the 0 V control signal is input into each supply unit 14, and each supply unit 14 turns on the LED 16 in a 50% dimmed lighting mode when the 2.5 V control signal is input into each supply unit 14.

In this case, in the present embodiment, only one LED 16 is shown in each supply unit 14. But the number of LEDs 16 is not limited to this and a plurality of LEDs can be employed. Also, a plurality of LEDs can be connected in series or in parallel.

Also, a multi-chip LED can be employed as the LED 16. Also, as shown in FIG. 2, the configuration in which three switching regulators 42 and three shunt resistors R1 are provided and the LED 16 is provided to the switching regulator 42 respectively can be employed as a supply unit 58. In this case, the terminal 44 is connected to the power supply input terminal (+B) 38, the terminals 46, 50, 52 are connected to the distribution terminals 24, 26, 28, the terminal 48 is connected to the power supply input terminal (GND) 40, and the LED 16 is connected to the terminal 54 and the terminal 56 respectively.

As shown in FIG. 3, the switching regulator 42 is constructed to have a transformer T, capacitors C1, C2, a diode D1, an NMOS transistor 60, and a control circuit 62 composed of IC. Also, the switching regulator 42 is constructed to have resistors R2, R3, R4, R5, R6, capacitors C3, C4, and PNP transistors 64, 66 in addition to the resistor R1, as circuit elements used to control the switching regulator 42. A connection point between the resistor R2 and the capacitor C3 is connected to the control circuit 62 via a current sensing terminal 68. One end of the resistor R3 is connected to the reference voltage 5 V. One end of the resistor R4 is connected to any one of the distribution terminals 24, 26, 28, 30 via the resistor R4.

The current sensing terminal 68 is constructed as the terminal that is used to convert the current flowing through the LED 16 to the voltage and feed back the sensed voltage to the control circuit 62. The control circuit 62 controls a switching operation of the NMOS transistor 60 in such a manner that the voltage of the current sensing terminal 68 can be maintained at a constant voltage, i.e., the current flowing through the LED 16 can be maintained constant.

Here, supposed that the voltage of the current sensing terminal 68 is controlled at 0.14 V, an operation of the switching regulator 42 will be explained as follows. For example, when the voltage of the control signal being input into the terminal 48 is set to 5 V or more, the voltage of (5 V-$V_{BE}$) or more is applied to a base of the PNP transistor 66 via a diode of the PNP transistor 66 and thus the PNP transistor 64 is turned off. Therefore, the switching regulator 42 executes the control such that a voltage drop developed across the shunt resistor R1 becomes 0.14 V. At this time, the current of (0.14 V÷0.2 Ω=) 0.7 A flows through the LED 16 when a resistance value of the shunt resistor R1 is set to 0.2 Ω, and the current flowing through the LED 16 becomes 1.4 A when the resistance value of the shunt resistor R1 is set to 0.1 Ω.

In the meanwhile, when the voltage of the control signal is set to 3 V, this 3 V voltage is applied to an emitter of the PNP transistor 66 via a low-pass filter, which consists of the resistor R4 and the capacitor C4, and then is applied to a base of the PNP transistor 64 via a diode of the PNP transistor 66. A voltage of 3 V-$V_{BE}$ is applied to a base of the PNP transistor 66. Therefore, a current of ((5V-$V_{BE}$)−(3V-$V_{BE}$))÷R3=(5V−3V)÷R3 flows through an emitter of the PNP transistor 64, and this current flows into the current sensing terminal 68. Because the input terminal of the control circuit 62 composed of IC is constructed to have the high impedance, the current that cannot flow into the current sensing terminal 68 passes through the shunt resistor R1. Therefore, a voltage drop of R2(5V−3V)÷R3 is developed across the resistor R2. As a result, the voltage drop developed across the shunt resistor R1 as well as the voltage drop developed across the resistor R2 is generated as an offset. In other words, the voltage (0.14 V) of the current sensing terminal 68 becomes equal to the voltage drop across the shunt resistor R1+the voltage drop across the resistor R2. In this case, the voltage $V_{BE}$ of the diode in the PNP transistor 66 is used to correct the base-emitter voltage $V_{BE}$ of the PNP transistor 64.

The case where the analog signal is input into the terminal 48 as the control signal is described. But this is similarly true of the case where the pulse signal is input into the terminal 48. For example, when a signal having an amplitude of 5 V and a duty ratio of 60% is input as the pulse signal, this pulse signal is rectified to 3 V by the low-pass filter consisting of the resistor R4 and the capacitor C4. Then, when this rectified voltage (3 V) is applied to the emitter of the PNP transistor 66, the voltage of (3 V-$V_{BE}$) is applied to the base of the PNP transistor 64, then the current of (5V−3V)÷R3 flows through the emitter of the PNP transistor 64, and then this current tends to flow into the current sensing terminal 68. In other words, the similar current to that derived by the analog signal flows through the resistor R2, and also the similar control to that applied to the analog signal is executed in the switching regulator 42.

At this time, for example, when R3:R2=35.7:1 is set, the control is executed by the switching regulator 42 such that the voltage drop of 0.056 V is developed across the resistor R2 and the voltage drop of 0.084 V is developed across the shunt resistor R1. That is, the current flowing through the LED 16 becomes 0.42 A when the resistance value of the shunt resistor R1 is set to 0.2 Ω, and also the same current becomes 0.84 A when the resistance value of the shunt resistor R1 is set to 0.1 Ω. Also, when the voltage of the control signal being input into the supply unit 14 is set to 2.5 V, the voltage drop of 0.07 V is developed across the resistor R2. Then, the current flowing through the LED 16 becomes 0.35 A when the resistance value of the shunt resistor R1 is set to 0.2 Ω, and the same current becomes 0.7 A when the resistance value of the shunt resistor R1 is set to 0.1 Ω, so that the current flowing through the LED 16 is reduced by half.

Then, even though all the supply units 14 have different currents supplied to respective LEDs 16, the voltage value sensed by the shunt resistor R1 is controlled to have the same value and therefore standardization of respective supply units 14 can be attained. Also, the resistance value of the shunt resistor R1 is set to 0.2 Ω when the current of 0.7 A should be supplied to the LED 16, and the resistance value of the shunt resistor R1 is set to 0.1 Ω when the current of 1.4 A should be supplied. In other words, the voltage value derived by the current×(the resistance value of the shunt resistor R1) is kept constant and also the voltage of the current sensing terminal 68 is set to the same voltage, i.e., 0.14 V.

In this manner, each control unit 14 can control the brightness of each LED 16 by using the voltage or duty ratio of the control signal. For example, when the voltage of the control signal is set to 2.5 V, the brightness is given as the full lighting mode×0.5, and also the current is given by 0.35 A (the resistance value of the shunt resistor R1=0.2 Ω) when the current in the full lighting mode is 0.7 A, and the current is given by 0.7 A (the resistance value of the shunt resistor R1=0.1 Ω) when the current in the full lighting mode is 1.4 A. Also, when the voltage of the control signal is set to 3 V, the brightness is given as the full lighting mode×0.6, and also the current is changed from 0.7 A to 0.42 A when the resistance value of the shunt resistor R1 is set to 0.2 Ω, and the current is changed from 1.4 A to 0.84 A when the resistance value of the shunt resistor R1 is set to 0.1 Ω.

Also, the control signal being output from the control unit 14 can be output not only as the analog signal using a D/A (digital/analog converter) in the microcomputer but also as the pulse signal from an I/O (input/output interface).

In this manner, in the present embodiment, no matter how many supply units 14 are provided to meet the characteristics of the LEDs 16 respectively, respective supply units 14 can take the same action on the same control signal, so that the configurations of respective circuits can be standardized. Also, no matter how the contents of the control signals are different every type of the car or every vehicle and its specifications are also different, the contents of the control signals, i.e. the specifications can be changed according to the contents of the communication signal, so that the standardization of the configurations of respective circuits can be achieved even when the specifications are changed for every type of the car or every vehicle. Accordingly, the development costs required to develop the lighting control circuit for the vehicle lighting equipment can be reduced and as a result a cost reduction of the product can be accomplished.

Next, a second embodiment of the present invention will be explained with reference to FIG. 4 and FIG. 5. In the present embodiment, a power supply portion 12*a* is provided to the control unit 12, then the DC power is introduced into the power supply portion 12*a* from the battery, and then the DC power (DC signal) is distributed to respective supply units 14 from the power supply portion 12*a*. Remaining configurations are similar to those in FIG. 1.

More specifically, the power supply portion 12*a* has a diode D2 as a reverse-connected protecting element, a Zener diode Z1 as a surge protecting element, and a noise filter consisting of capacitors C5, C6 and a coil L1, and a plurality of power supply output terminals 70, 72, 74, 76, 78, 80, 82, 84 are provided to the output side of the noise filter. The anode side of the diode D2 is connected to the power supply input terminal (+B) 38 via the terminal 20, while the cathode side thereof is connected to the power supply input terminal (GND) 40 via the Zener diode Z1 and the terminal 22. This diode D2 is provided such that, when the power supply input terminals 38, 40 are connected to the terminals with opposite polarities to the positive terminal and the negative terminal of the battery respectively, the DC current can be prevented from entering into the power supply portion 12*a* to protect circuit elements, etc. of the control unit 12 from the reversed connection. The Zener diode Z1 is connected in parallel across the capacitor C5 and absorbs a surge voltage when the surge voltage is applied between the terminal 20 and the terminal 22. The noise filter consisting of the capacitors C5, C6 and the coil L1 is provided to eliminate a noise component that is superposed on the DC signal being input from the terminal 20 via the diode D2.

Meanwhile, the power supply output terminals 70, 72, 74, 76 are connected to the terminals 44 of the supply units 14 respectively, and the power supply output terminals 78, 80, 82, 84 on the GND side are connected to the terminals 52 of the supply units 14 respectively.

That is, in the present embodiment, in distributing the DC power (DC) signal from the battery to respective supply units 14 via the power supply portion 12*a*, such a configuration is employed that the power supply output terminals 70, 72, 74, 76 are connected to the terminals 44 of the supply units 14 respectively and also the power supply output terminals 78, 80, 82, 84 are connected to the terminals 52 of the supply units 14 respectively. Because such configuration is employed, the number of wirings can be reduced to contribute a cost reduction rather than the system that, as shown in FIG. 1, the power from the battery is supplied sequentially from the supply units 14 on the upper stage side to the supply units 14 on the lower stage side.

Also, the power is supplied from the power supply portion 12*a* to respective supply units 14. Therefore, without provision of the diode D2, the Zener diode Z1, and the noise filter every supply unit 14, the supply units 14 can be protected and also the entering of the noise into respective supply units 14 can be prevented. In this case, the switching element such as FET, or the like can be employed instead of the diode D2.

Next, a third embodiment of the present invention will be explained with reference to FIG. 6. In the present embodiment, an abnormality sensing means for outputting an abnormal signal on a control signal line CL, which connects the distribution terminal 24 (26, 28, 30) of the control unit 12 and the terminal 48 of the supply unit 14, when the control unit 12 senses an abnormality of the LED 16 is provided to each supply unit 14. Also, an abnormal information outputting means for outputting an abnormal information when the abnormal information is input into the control unit 12 from any one of the supply units 14 via the control signal line CL is provided to the control unit 12.

More specifically, as the abnormality sensing means, resistors R7, R8, R9, R10, an NPN transistor 86, and comparators 88, 90 are provided to each supply unit 14. When a current If of the LED 16 is reduced lower than a set value, the comparator 88 decides the abnormality of the LED 16, e.g., a short-circuit abnormality of the LED 16, and then its open collector output goes to a low level to turn off the NPN transistor 86.

Also, when a voltage Vf of the LED 16 is reduced lower than a set voltage, the comparator 90 decides the abnormality of the LED 16, and then its open collector output goes to a low level to turn off the NPN transistor 86. Then, when the NPN transistor 86 is turned off, the current seldom flows through the control signal line CL, like the case where the control signal line CL for connecting the distribution terminal 24 and the terminal 48 of the supply unit 14 is disconnected, for example. As a result, the control unit 12 decides that the abnormality occurs in the LED, and then the abnormality signal is output from the supply unit 14, which sensed the abnormality, to the control unit 12 via the control signal line CL.

Meanwhile, as the abnormal information outputting means, resistors R11, R12, R13, R14, NPN transistors 92, and comparators 94 are provided to each control unit 12 to correlate with each supply unit 14 respectively. The, resistor R11 is connected to the control signal line CL and also connected to the I/O (input/output interface) of CPU or the D/A (digital/analog converter). Also, both ends of the resistor R11 are connected to input terminals of the comparator 94 respectively, and an output side of the comparator 94 is connected to an emitter of the NPN transistor 92. A collector of the NPN transistor 92 is connected to an abnormality information output terminal 96, and a base thereof is connected to a connection point between the resistor R12 and the resistor R13. Since a voltage drop is developed across the resistor R11 when the current is flowing through the control signal line CL, the output side of the comparator 94 goes to a high level and thus the NPN transistor 92 is in its OFF state. Therefore, a voltage level of the abnormality information output terminal 96 is maintained at a high level.

In contrast, since the voltage drop is not developed across the resistor R11 when the current does not flow through the control signal line CL, an open collector output side of the comparator 94 goes to a low level and thus the NPN transistor 92 is turned on. The voltage level of the abnormality information output terminal 96 is inverted from the high level to a low level. Then, when the voltage level of the abnormality information output terminal 96 goes to the low level, the driver is informed of the abnormality information by an abnormality information alarm unit (not shown) connected to the abnormality information output terminal 96. As a consequence, the driver can catch the fact that the abnormality occurs in any LED 16.

In the present embodiment, the abnormality information is transmitted using the control signal line CL. Therefore, this control signal line CL can be used commonly as a control signal transmission line and an abnormal signal transmission line.

Also, in the present embodiment, since the NPN transistor 92 is connected to the output side of the comparator 94, it can be prevented that, when the voltage of the control signal is low, the abnormality is sensed in error. For example, when the voltage of the control signal is reduced to about 1 V, the current flowing through the control signal line is also reduced small by the control signal, then the voltage drop developed across the resistor R11 is also lowered, and thus an accuracy in sensing the voltage drop is also deteriorated. In fact, the low voltage of the control signal brings forth such a situation that a large current is not supplied to the LED 16 even in its normal operation and the LED 16 is turned on in its darkened condition. For this reason, there is no necessity at this time to sense forcibly the fact that the current is reduced small.

Also, in case the pulse signal is used as the control signals, the sensing of the abnormality can be masked when the level of the pulse signal is at the low level. Therefore, even when the analog signal or the pulse signal is used as the control signals, the control signals are not sensed as the abnormal signal but output to the supply units 14. As a result, when the supply unit 14 senses the abnormality of the LED 16, such supply unit 14 causes the current not to flow through the control signal line CL and can inform surely the driver of the fact that the abnormality occurs in the LED 16. Also, the driver can be informed of the abnormality of the LED 16 while using the control signal line CL commonly so as not to increase the number of wirings.

FIGS. 1, 4:
(1) control unit 12
(2) supply unit 14
(3) switching regulator 42
(4) communication signal FIG. 2:
(1) switching regulator 42
(2) supply unit 58

FIG. 6:
(1) control unit 12
(2) supply unit 14
(3) I/O or D/A
(4) abnormal information
(5) control signal
(6) shunt resistance
(7) led cathode
(8) to a current sensing terminal
(9) high resistance
(10) L output when If is low
(11) L output when Vf is low

We claim:

1. A lighting control circuit for vehicle lighting equipment, comprising:

control signal generating means for generating control signals in response to a communication signal fed from a vehicle; and plurality of current supplying means for controlling a supply of current to a plurality of semiconductor light sources in compliance with the control signals generated by the control signal generating means;

wherein, when a change is made to contents of the communication signal from the vehicle, the control signal generating means changes contents of the control signals in response to the contents of the communication signal, and the contents of the communication signal from the vehicle vary according to a specification of the vehicle.

2. A lighting control circuit for vehicle lighting equipment, according to claim 1, wherein the plurality of current supplying means take a same action on a same control signal out of the control signals generated by the control signal generating means respectively.

3. A lighting control circuit for vehicle lighting equipment, according to claim 2, wherein the control signal generating means includes a pair of power supply input terminals connected to a DC power supply loaded on the vehicle, and a plurality of power supply output terminals for distributing a DC power supplied to the pair of power supply input terminals to the current supplying means, and also includes a reverse-connected protecting element connected to one power supply input terminal of the pair of power supply input terminals or a surge protecting element for absorbing a surge voltage applied between the pair of power supply input terminals, or a noise filter for eliminating a noise component superposed onto a DC signal being input via the reverse-connected protecting element and then out-putting the DC signal, from which the noise component is eliminated, to the power supply output terminals.

4. A lighting control circuit for vehicle lighting equipment, according to claim 3, wherein the plurality of current supplying means includes abnormality sensing means for outputting an abnormal signal on control signal lines, which connect the control signal generating means and the plurality of current supplying means respectively, when the abnormality sensing means senses an abnormality caused due to a supply of power to the semiconductor light sources, and the control signal generating means includes abnormal information outputting means for outputting the control signals on the control signal lines, and also monitoring respective states of the control signal lines to output an abnormal information when the abnormal signal is input from any of the plurality of current supplying means.

5. A lighting control circuit for vehicle lighting equipment, according to claim 2, wherein the plurality of current supplying means includes abnormality sensing means for outputting an abnormal signal on control signal lines, which connect the control signal generating means and the plurality of current supplying means respectively, when the abnormality sensing means senses an abnormality caused due to a supply of power to the semiconductor light sources, and the control signal generating means includes abnormal information outputting means for outputting the control signals on the control signal lines, and also monitoring respective states of the control signal lines to output an abnormal information when the abnormal signal is input from any of the plurality of current supplying means.

6. A lighting control circuit for vehicle lighting equipment, according to claim 1, wherein the control signal generating means includes a pair of power supply input terminals connected to a DC power supply loaded on the vehicle, and a plurality of power supply output terminals for distributing a DC power supplied to the pair of power supply input terminals to the current supplying means, and also includes a reverse-connected protecting element connected to one power supply input terminal of the pair of power supply input terminals or a surge protecting element for absorbing a surge voltage applied between the pair of power supply input terminals, or a noise filter for eliminating a noise component superposed onto a DC signal being input via the reverse-connected protecting element and then out-putting the DC signal, from which the noise component is eliminated, to the power supply output terminals.

7. A lighting control circuit for vehicle lighting equipment, according to claim 6, wherein the plurality of current supplying means includes abnormality sensing means for outputting an abnormal signal on control signal lines, which connect the control signal generating means and the plurality of current supplying means respectively, when the abnormality sensing means senses an abnormality caused due to a supply of power to the semiconductor light sources, and the control signal generating means includes abnormal information outputting means for outputting the control signals on the control signal lines, and also monitoring respective states of the control signal lines to output an abnormal information when the abnormal signal is input from any of the plurality of current supplying means.

8. A lighting control circuit for vehicle lighting equipment, according to claim 1, wherein the plurality of current supplying means includes abnormality sensing means for outputting an abnormal signal on control signal lines, which connect the control signal generating means and the plurality of current supplying means respectively, when the abnormality sensing means senses an abnormality caused due to a supply of power to the semiconductor light sources, and the control signal generating means includes abnormal information outputting means for outputting the control signals on the control signal lines, and also monitoring respective states of the control signal lines to output an abnormal information when the abnormal signal is input from any of the plurality of current supplying means.

* * * * *